US005383621A

United States Patent [19]

Alexander

[11] Patent Number: 5,383,621

[45] Date of Patent: Jan. 24, 1995

[54] PACKAGE ADAPTER HAVING AN ADJUSTABLE BASE

[76] Inventor: James L. Alexander, 1024 N. Tryon St., Charlotte, N.C. 28206

[21] Appl. No.: 35,729

[22] Filed: Mar. 23, 1993

[51] Int. Cl.[6] ..... B65H 49/06

[52] U.S. Cl. ..... 242/130; 242/129.7; 242/131; 403/109; 403/325

[58] Field of Search ..... 242/130, 130.1, 131, 242/129.5, 129.7, 129.71; 403/321, 322, 325, 109

[56] References Cited

U.S. PATENT DOCUMENTS

| | | | |
|---|---|---|---|
| 925,042 | 6/1909 | Shaw | 403/321 X |
| 1,844,760 | 2/1932 | Haynes | 403/109 X |
| 2,664,259 | 12/1953 | Rose | 403/109 X |
| 3,018,122 | 1/1962 | Frei et al. | 403/325 X |
| 3,199,818 | 8/1965 | Ahara | 403/109 X |
| 3,734,441 | 5/1973 | Lux | 403/109 X |
| 3,841,196 | 10/1974 | Tinnerman | 403/322 X |
| 3,893,730 | 7/1975 | Homier et al. | 403/322 X |
| 4,941,622 | 6/1990 | Alexander | 242/129.7 |
| 4,995,569 | 2/1991 | Alexander | 242/130 |
| 5,170,979 | 1/1992 | Baber | 242/131 X |

FOREIGN PATENT DOCUMENTS

| | | | |
|---|---|---|---|
| 140597 | 6/1949 | Australia | 403/325 |
| 2300750 | 7/1973 | Germany | 403/109 |
| 530505 | 12/1940 | United Kingdom | 403/109 |
| 2258151 | 2/1993 | United Kingdom | 403/109 |

*Primary Examiner*—Stanley N. Gilreath
*Attorney, Agent, or Firm*—Rhodes Coats & Bennett

[57] ABSTRACT

A yarn package adapter having an adjustable base for receiving and engaging a package of strand material wound about an elongate hollow core. The adapter includes a central shaft adapted to be mounted to the creel and having means mounted on the central shaft for engaging the inside diameter of the package core. The adapter also includes a base having an aperture for receiving the central shaft therealong and for forming a sliding abutment for engaging an end of the package core and a releasable locking mechanism attached to the base for engaging the central shaft and preventing movement of the base along the shaft. The locking mechanism includes a generally planar elongate strip having an aperture for receiving the central shaft and means for attaching one end of the strip to the base and biasing means located between the elongate strip and the base for forcing the other end of the strip away from the base, whereby the inner surface of the aperture releasably engages the surface of the central shaft and prevents movement of the base along the shaft. The adapter further includes a length of tubular material for restricting the movement of the base along the central shaft, thereby preventing the base from contacting the means mounted on the central shaft for engaging the inside diameter of the package core.

22 Claims, 3 Drawing Sheets

PACKAGE ADAPTER HAVING AN ADJUSTABLE BASE

BACKGROUND OF THE INVENTION

1. Field of the Invention

The present invention related generally to a package adapter for handling textile strand material packages and, more particularly, to a package adapter having an adjustable base operable to adapt to and to hold a range of sizes and types of such packages.

2. Description of the Prior Art

Textile processes have used a wide variety and range of configurations and sizes of packages formed by winding strand material about elongated, hollow cores. Two examples are the winding of yarn about circular cylindrical cores into packages and the winding of yarn about conical cores. In both instances, the size of a package core and the size of a completed package can vary with individual producers often choosing package configuration sizes unique to themselves.

The proliferation of package sizes and types represent problems for the manufacturer who uses package strands in the further processing of the textile materials, such as a weaving mill. Unless great care is taken in the consistent selection of strand materials and suppliers, strand materials in a number of various package configuration types will come into a mill for use. As that occurs, some accommodation must be made to the various sizes and types of packages. Several approaches have been taken to solve this problem.

U.S. Pat. No. 4,941,622, issued to Alexander, discloses an apparatus for receiving and mounting or supporting strand material packages formed by winding strand material such as textile strands about hollow, elongated cores. The apparatus has a central shaft, a rear support mounted on the shaft for engaging one end of the package core, and a plurality of fingers for engaging the inside diameter of the core. The rear support and fingers together support a package which accommodates cores of various sizes and types. Operation of the rear support and fingers is coordinated by a linkage and a latch which interconnects these elements and the shaft.

U.S. Pat. No. 5,170,979, issued to Baber, discloses a universal package support for packages of yarn having various inside diameters and lengths. The support has a moveable disk, slidably supported on a shaft, which slides in and out to actuate a plurality of pivotly-mounted levers to engage and disengage the surface of a yarn tube mounted thereon.

Finally, U.S. Pat. No. 4,995,569 discloses an apparatus for receiving and mounting or supporting strand material packages formed by winding strand materials such as textile strands about hollow, elongated cores. The apparatus has a central shaft and a plurality of sets of finger members and connecting link members mounted for movement relative to the shaft. Each set of fingers makes up, together with the shaft, a five-bar linkage in which the connecting link forms an engaging means which moves into engagement with the inner surface of an elongated, hollow package core for supporting the strand material. The entire disclosure of this patent is hereby incorporated by reference.

While each of these patents provide some means for adapting to various diameters of the elongated, hollow core, none of these references provide a means for independently adjusting the height of the base which supports the elongated, hollow core. Thus, there remains a need for a new and improved package adapter having an adjustable base which is adaptable for various diameters of the elongated, hollow core and, at the same time, is independently adjustable for the height of the elongated, hollow core.

SUMMARY OF THE INVENTION

The present invention is directed to a yarn package adapter having an adjustable base for receiving and engaging a package of strand material wound about an elongate hollow core. The adapter includes a central shaft adapted to be mounted to the creel and having means mounted on the central shaft for-engaging the inside diameter of the package core. The adapter also includes a base having an aperture for receiving the central shaft therealong and for forming a sliding abutment for engaging an end of the package core and a releasable locking mechanism attached to the base for engaging the central shaft and preventing movement of the base along the shaft.

The locking mechanism includes a generally planar elongate strip having an aperture for receiving the central shaft and means for attaching one end of the strip to the base and biasing means located between the elongate strip and the base for forcing the other end of the strip away from the base, whereby the inner surface of the aperture releasably engages the surface of the central shaft and prevents movement of the base along the shaft.

Also, in the preferred embodiment, the adapter further includes a length of tubular material for restricting the movement of the base along the central shaft, thereby preventing the base from contacting the means mounted on the central shaft for engaging the inside diameter of the package core.

Accordingly, one aspect of the present invention is to provide a yarn package adapter for a creel for receiving and engaging a package of strand material wound about an elongate hollow core. The adapter includes: (a) a central shaft adapted to be mounted to the creel; (b) means mounted on the central shaft for engaging the inside diameter of the package core; (c) a base having an aperture for receiving the central shaft therealong and for forming a sliding abutment for engaging an end of the package core; and (d) a releasable locking mechanism attached to the base for engaging the central shaft and preventing movement of the base along the shaft.

Another aspect of the present invention is to provide a releasable locking mechanism for a central shaft and a base having an aperture for receiving the central shaft therealong. The locking mechanism includes: (a) a generally planar elongate strip having an aperture for receiving the central shaft and means for attaching one end of the strip to the base; and (b) biasing means located between the elongate strip and the base for forcing the other end of the strip away from the base, whereby the inner surface of the aperture releasably engages the surface of the central shaft and prevents movement of the base along the shaft.

Still another aspect of the present invention is to provide a yarn package adapter for a creel for receiving and engaging a package of strand material wound about an elongate hollow core. The adapter includes: (a) a central shaft adapted to be mounted to the creel; (b) means mounted on the central shaft for engaging the inside diameter of the package core; (c) a base having an aperture for receiving the central shaft therealong and for forming a sliding abutment for engaging an end of the package core; and (d) a releasable locking mechanism attached to the base for engaging the central shaft and preventing movement of the base along the shaft, the locking mechanism including: (i) a generally planar elongate strip having an aperture for receiving the central shaft and means for attaching one end of the strip to the base; and (ii) biasing means located between the elongate strip and the base for forcing the other end of the strip away from the base, whereby the inner surface of the aperture releasably engages the surface of the central shaft and prevents movement of the base along the shaft.

These and other aspects of the present invention will become apparent to those skilled in the art after a reading of the following description of the preferred embodiment when considered with the drawings.

DESCRIPTION OF THE PREFERRED EMBODIMENTS

Figure 1:
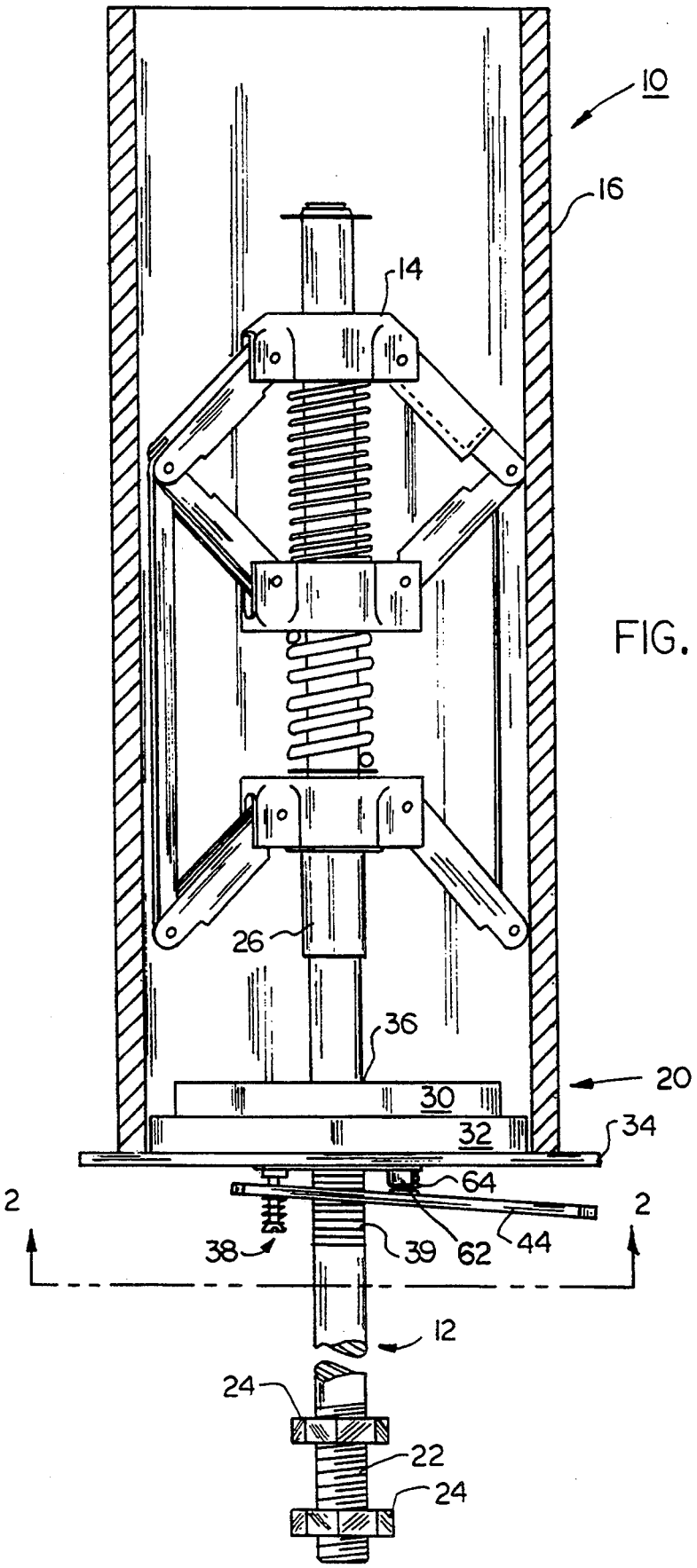
FIG. 1 is a partial cross-sectional view of a package adapter, constructed according to the present invention, in position for use with a yarn package mounted thereon.

In the following description, like reference characters designate like or corresponding parts throughout the several views. Also in the following description, it is to be understood that such terms as "forward", "rearward", "left", "right", "upwardly", "downwardly" and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a package adapter, generally designated 10, is shown constructed according to the present invention. The package adapter 10 includes a central shaft 12 including a package holder 14, such as described in U.S. Pat. No. 4,995,569. A yarn package 16, is centered about the central shaft 12 by package holder 14 and abuts against an adjustable base, generally designated 20. The end 22 of the central shaft 12 opposite the end attached to the package holder 14 is threaded to permit it to be attached to a textile machine (not shown) by a plurality of nuts 24.

A cylindrical spacer 26 is slidably mounted on central shaft 12 between package holder 14 and the upper surface of adjustable base 20. Spacer 26 prevents adjustable base 20 from being moved so close to the arms of package holder 14 as to interfere with their operation.

Adjustable base 20 includes a plurality of concentric, offset circular disks 30, 32, 34 having a central bore 36 defining a first aperture which is slidably mounted on central shaft 12. A locking mechanism, generally designated 38 is attached to the bottom side of adjustable base 20 and is operable to adjust the relative height of base 20 with respect to package 16. In the preferred embodiment, central shaft 12 includes a plurality of grooves 39 for engaging the locking mechanism.

Figure 2:
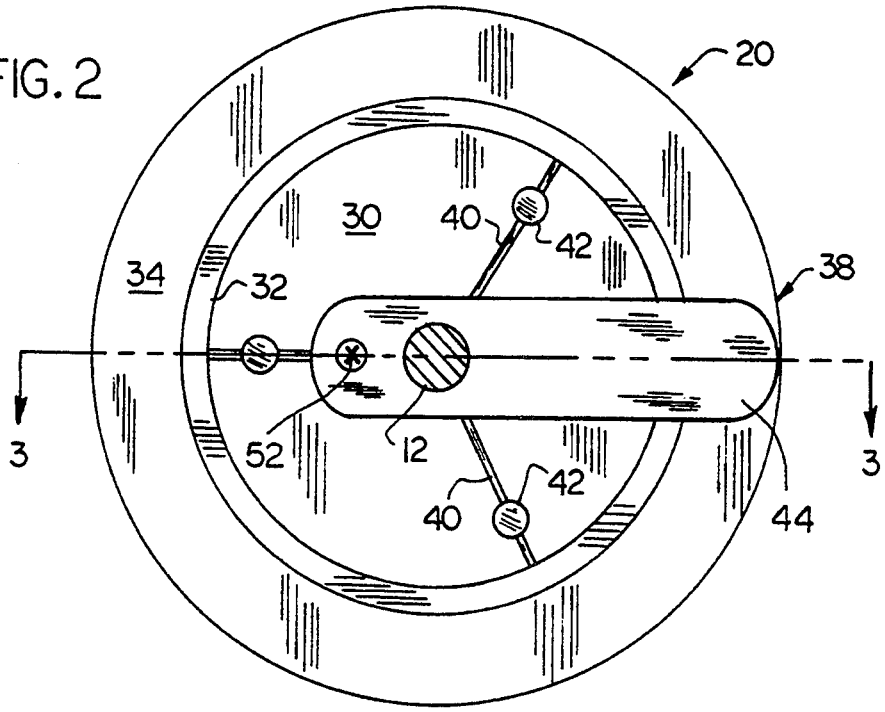
FIG. 2 is an enlarged bottom plan view of the adjustable base shown in FIG. 1, taken along line 2—2.

Turning to FIG. 2, there is shown an enlarged bottom plan view of the adjustable base shown in FIG. 1. Base 20 includes plurality of radially extending support spokes 40 extending from the central bore 36 of the base. In the preferred embodiment, support spokes 40 include a plurality of rod-shaped sections 42 which further add strength to the bottom of base 20.

Figure 3:
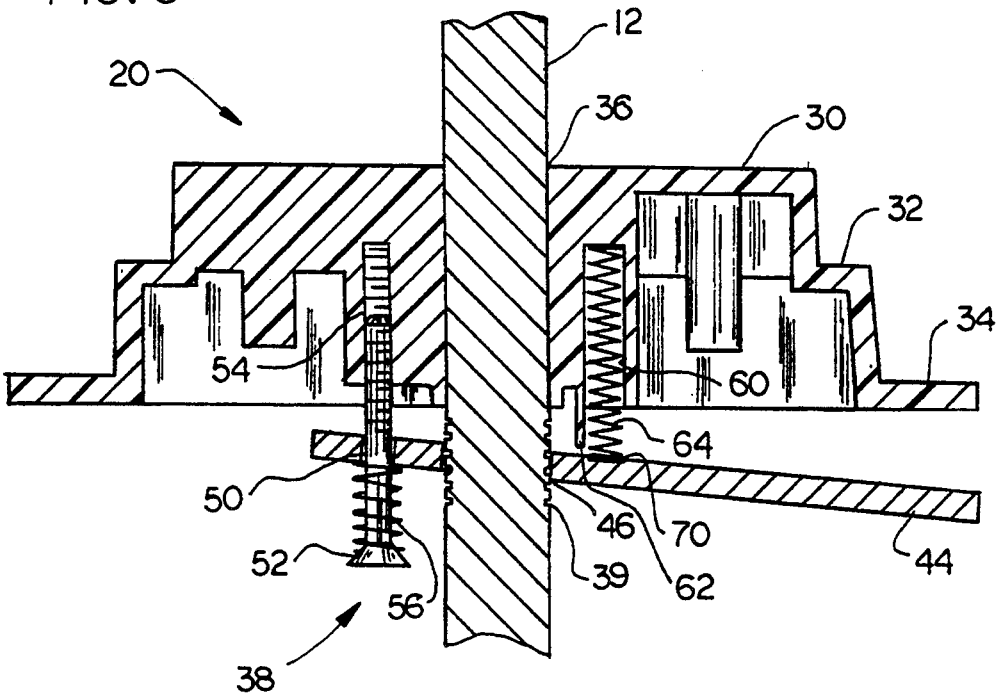
FIG. 3 is an enlarged cross-sectional view of the adjustable base shown in FIG. 2, taken along line 3—3.

As best seen in FIG. 3, there is shown an enlarged cross-sectional view of the adjustable base shown in FIG. 2. Locking mechanism 38 includes an elongated generally planer lever arm 44. Lever arm 44 includes a first aperture 46 sized to receive shaft 12. In the preferred embodiment, the diameter of aperture 46 is between about 0.003 and 0.005 inches greater in diameter than the diameter of shaft 12. This additional diameter permits lever arm 44 to be moved with respect to the shaft when it is perpendicular to the shaft but causes the lever arm to bind on the surface of the shaft if there is an appreciable angle between the two.

A second aperture 50 permits a threaded fastener 52 to be threaded into thread bore 54 on the lower surface of base 20. A first spring 56 located between aperture 50 and the head of threaded fastener 52 exerts an upward force on the end of lever arm 44 adjacent to second aperture 50. This force is sufficient to cause the lever arm 44 to depart from perpendicular and to bind with the surface of central shaft 12.

In the preferred embodiment, base 20 also includes a smooth bore 60 having a partial shoulder 62 extending therefrom for receiving a second spring 64 which exerts a downward force on the opposite side of lever arm 44. Also in the preferred embodiment, a partial recess 70 in the upper surface of lever arm 44 acts to maintain the position of end of spring 64 against the surface of lever arm 44. This arrangement forms a first-class lever.

In operation, the combination of springs 56, 64 exerts a clock-wise rotation on lever arm 44 causing the opposite edges of aperture 46 to bind on the surface of central shaft 12. It has been found that the combination of partial shoulder/pivot point 62 with second spring 64 provides a more stable base which is less susceptible to unlocking and sliding due to vibration of the textile machinery.

Figure 4:
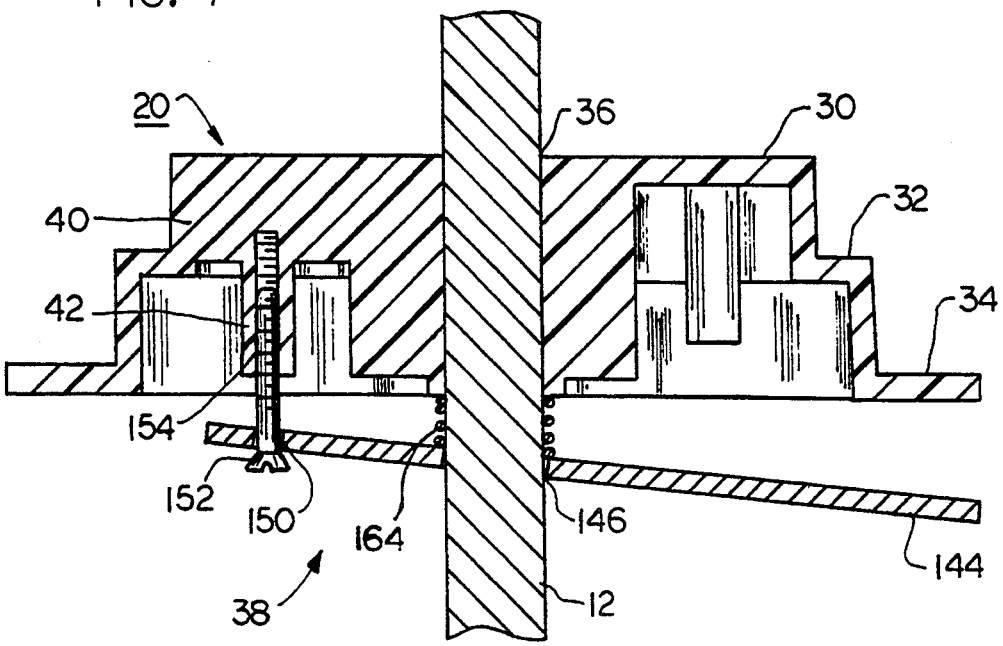
FIG. 4 is an enlarged cross-sectional view of an alternative embodiment of the adjustable base.

Turning to FIG. 4, there is shown an enlarged cross-sectional view of an alternative embodiment of the adjustable base locking mechanism. In this embodiment, lever arm 144 also includes an aperture 146 sized between about 0.003 and 0.005 inches greater than the diameter of shaft 12. A second aperture 150 on the opposite end of the lever arm 144 receives a fastener 152 into threaded bore 154. A spring 164 surrounds the shaft 12 and is located between the bottom center section of base 20 and the upper surface of lever arm 144. This arrangement forms a second-class lever.

In operation, the head of fastener 152 acts as the pivot point when the end opposite the fastener is lifted upward thereby compressing spring 164. When the lever 144 is parallel to the lower surface of base 20, there is sufficient clearance between aperture 146 and central shaft 12 to permit the movement of the base along the length of central shaft 12.

Figure 5:
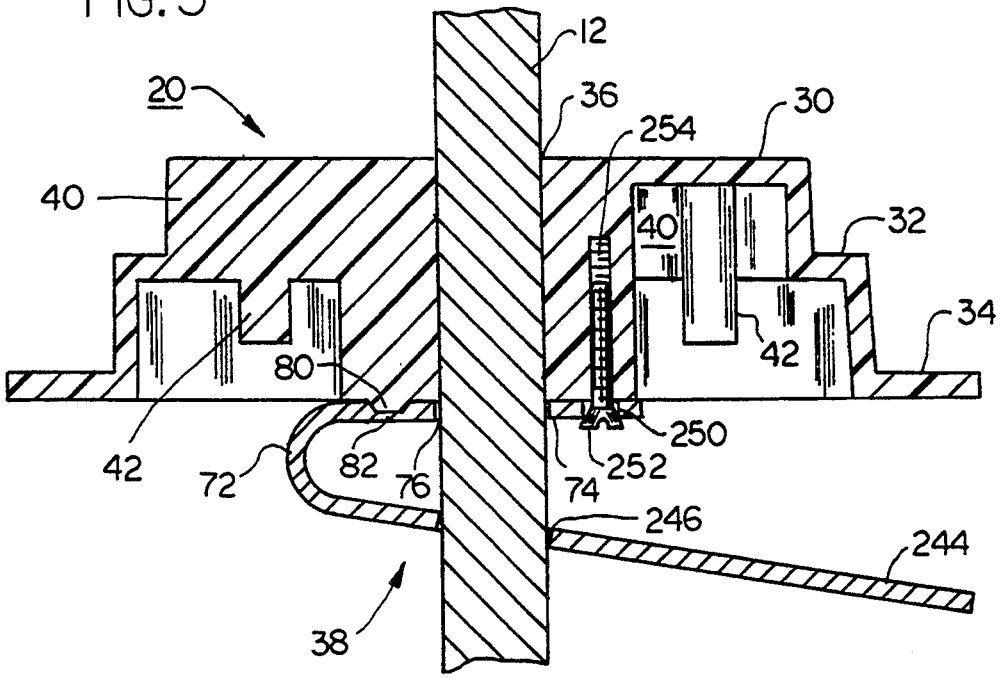
FIG. 5 is an enlarged cross-sectional view of another alternative embodiment of the adjustable base.

Finally, turning to FIG. 5, there is shown an enlarged cross-sectional view of another alternative embodiment of the adjustable base locking mechanism 38. In this embodiment, one end of lever arm 244 is formed into a curved portion 72 which acts as both the pivot point and the spring. The curved portion 72 extends and forms a base 74. Base 74 includes a second aperture 250 for receiving a fastener 252 which is engaged in threaded bore 254 in base 20 to attach base 74 to the bottom of base 20. In this embodiment, base 74 of the lever arm 244 includes a third aperture 76 which is sized to slidably fit over central shaft 12. Base 20 may also have a tab 80 and base 74 may also have a recess 82 to further stabilize the lever arm 244 with respect to base 20.

In operation, when the far end of lever arm 244 is raised, the lever pivots about curve portion 72 until the lever is approximately parallel with the bottom of base 20. At that point, there is sufficient clearance between first aperture 246 and the surface of central shaft 12 to permit base 20 and locking mechanism 38 to be moved along the length of shaft 12.

Certain modifications and improvements will occur to those skilled in the art upon a reading of the foregoing description. By way of example, compressible plastic materials could be substituted for the compression springs. It should be understood that all such modifications and improvements have been deleted herein for the sake of conciseness and readability but are properly within the scope of the following claims.

I claim:

1. A yarn package adapter for a creel for receiving and engaging a package of strand material wound about an elongate hollow core, said adapter comprising:

(a) a central shaft adapted to be mounted to said creel;

(b) means mounted on said central shaft for engaging the inside diameter of said package core;

(c) a base having an aperture for receiving said central shaft therealong and for forming a sliding abutment for engaging an end of said package core;

(d) a releasable locking mechanism attached to said base for engaging said central shaft and preventing movement of said base along said shaft; and (e) means for restricting the movement of said base along said central shaft, thereby preventing said base from contacting said means mounted on said central shaft for engaging the inside diameter of said package core.

2. The adapter according to claim 1, wherein said means for restricting the movement of said base along said central shaft is a length of tubular material.

3. The adapter according to claim 1, wherein said central shaft includes a free end and a opposite end and means for attaching said central shaft to said creel located on said opposite end.

4. The adapter according to claim 3, wherein said central shaft includes a plurality of perpendicular grooves located between said free end and said opposite end for engaging said locking mechanism.

5. The adapter according to claim 1, wherein said base having an aperture for receiving said central shaft therealong is generally circular and includes a central bore having a plurality of radially extending support spokes.

6. The adapter according to claim 1, wherein said base having an aperture for receiving said central shaft therealong includes a plurality of concentric, offset circular disks to accommodate different size package cores.

7. A releasable locking mechanism for a central shaft and a base having an aperture for receiving said central shaft therealong, said locking mechanism comprising:

(a) a generally planar elongate strip having an aperture for receiving said central shaft and means for attaching one end of said strip to said base;

(b) first biasing means located adjacent said elongate strip and opposite said base for forcing said one end of said strip towards said base; and (c) second biasing means located between said elongate strip and said base for forcing the other end of said strip away from said base, whereby the inner surface of said aperture releasably engages the surface of said central shaft and prevents movement of said base along said shaft in either direction.

8. The locking mechanism according to claim 7, wherein said base is generally circular and said other end of said strip extends to the rim of said base.

9. The locking mechanism according to claim 7, wherein said means for attaching one end of said strip to said base is a second aperture in said strip for receiving a threaded fastener for engaging said base and said first biasing means includes a first spring located on said threaded fastener between the head of said threaded fastener and said strip.

10. The locking mechanism according to claim 9, wherein said second biasing means further includes a shoulder for engaging said strip located on the side of said base adjacent said central shaft and opposite said fastener.

11. The locking mechanism according to claim 10, wherein said second biasing means further includes a second spring located adjacent said shoulder for engaging said strip.

12. A yarn package adapter for a creel for receiving and engaging a package of strand material wound about an elongate hollow core, said adapter comprising:

(a) a central shaft adapted to be mounted to said creel;

(b) means mounted on said central shaft for engaging the inside diameter of said package core;

(c) a base having an aperture for receiving said central shaft therealong and for forming a sliding abutment for engaging an end of said package core; and (d) a releasable locking mechanism attached to said base for engaging said central shaft and preventing movement of said base along said shaft, said locking mechanism including: (i) a generally planar elongate strip having an aperture for receiving said central shaft and means for attaching one end of said strip to said base; (ii) first biasing means located adjacent said elongate strip and opposite said base for forcing said one end of said strip towards said base; and (iii) second biasing means located between said elongate strip and said base for forcing the other end of said strip away from said base, whereby the inner surface of said aperture releasably engages the surface of said central shaft and prevents movement of said base along said shaft in either direction.

13. The adapter according to claim 12, further including means for restricting the movement of said base along said central shaft, thereby preventing said base from contacting said means mounted on said central shaft for engaging the inside diameter of said package core.

14. The adapter according to claim 13, wherein said means for restricting the movement of said base along said central shaft is a length of tubular material.

15. The adapter according to claim 12, wherein said central shaft includes a free end and a opposite end and means for attaching said central shaft to said creel located on said opposite end.

16. The adapter according to claim 15, wherein said central shaft includes a plurality of perpendicular grooves located between said free end and said opposite end for engaging said locking mechanism.

17. The adapter according to claim 12, wherein said base having an aperture for receiving said central shaft therealong is generally circular and includes a central bore having a plurality of radially extending support spokes.

18. The adapter according to claim 12, wherein said base having an aperture for receiving said central shaft therealong includes a plurality of concentric, offset circular disks to accommodate different size package cores.

19. The locking mechanism according to claim 12, wherein said base is generally circular and said other end of said strip extends to the rim of said base.

20. The locking mechanism according to claim 12, wherein said means for attaching one end of said strip to said base is a second aperture in said strip for receiving a threaded fastener for engaging said base and said first biasing means includes a first spring located on said threaded fastener between the head of said threaded fastener and said strip.

21. The locking mechanism according to claim 20, wherein said second biasing means further includes a shoulder for engaging said strip located on the side of said base adjacent said central shaft and opposite said fastener.

22. The locking mechanism according to claim 21, wherein said second biasing means further includes a second spring located adjacent said shoulder for engaging said strip.

* * * * *